US010570756B2

(12) United States Patent
Sieber et al.

(10) Patent No.: US 10,570,756 B2
(45) Date of Patent: Feb. 25, 2020

(54) CLOSING ASSEMBLY FOR CLOSING A BLADE RING, ASSOCIATED BLADE SUPPORTS, TURBOMACHINE, AND METHOD FOR INSERTING A CLOSING ASSEMBLY

(71) Applicant: Siemens Aktiengesellschaft, Munich (DE)

(72) Inventors: Uwe Sieber, Mülheim an der Ruhr (DE); Dimitri Zelmer, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 185 days.

(21) Appl. No.: 15/547,630

(22) PCT Filed: Jan. 19, 2016

(86) PCT No.: PCT/EP2016/050990
§ 371 (c)(1),
(2) Date: Jul. 31, 2017

(87) PCT Pub. No.: WO2016/124392
PCT Pub. Date: Aug. 11, 2016

(65) Prior Publication Data

US 2018/0023402 A1 Jan. 25, 2018

(30) Foreign Application Priority Data

Feb. 5, 2015 (EP) ..... 15153995

(51) Int. Cl.
*F01D 5/32* (2006.01)
*F01D 5/30* (2006.01)

(52) U.S. Cl.
CPC ..... *F01D 5/32* (2013.01); *F01D 5/303* (2013.01); *F05B 2260/301* (2013.01);
(Continued)

(58) Field of Classification Search
CPC ..... F01D 5/303; F01D 5/3038; F01D 5/32; F01D 5/3053; F01D 5/326; F01D 5/30;
(Continued)

(56) References Cited

U.S. PATENT DOCUMENTS 2,421,855 A * 6/1947 Soderberg ..... F01D 5/3038 416/217
3,088,708 A * 5/1963 Feinberg ..... F01D 5/3038 416/215
(Continued)

FOREIGN PATENT DOCUMENTS

DE 102010060284 A1 5/2011
GB 639320 A * 6/1950 ..... F01D 5/3038
GB 659592 A * 10/1951 ..... F01D 5/3038

OTHER PUBLICATIONS

EP Search Report dated Jul. 16, 2015, for EP patent application No. 15153995.4.
(Continued)

*Primary Examiner* — Justin D Seabe
*Assistant Examiner* — Joshua R Beebe
(74) *Attorney, Agent, or Firm* — Beusse Wolter Sanks & Maire

(57) ABSTRACT

A closing assembly for closing a blade ring inserted into a circumferential T-groove of a blade support of a turbomachine, having two insertion elements, each has a C-shaped basic form having a resting leg, retention leg, and connection leg connecting the resting leg and the retention leg and is designed to reach around a ridge of the T-groove. The resting leg reaches over the ridge and the retention leg reaches under the ridge, and an intermediate element, is positioned between the insertion elements to prevent the insertion elements from moving to the center of the T-groove. The intermediate element reaches below the retention legs of the insertion elements in the assembled state, and
(Continued)

a positioning element is associated with the intermediate element, which is supported between the groove base of the T-groove and the intermediate element and to position the intermediate element at a desired distance from the groove base.

19 Claims, 5 Drawing Sheets

(52) U.S. Cl.
CPC .... *F05D 2250/281* (2013.01); *F05D 2250/75* (2013.01); *F05D 2260/30* (2013.01)

(58) Field of Classification Search
CPC ..... F01D 11/008; F05D 2230/60; F05D 2260/30; F05D 2250/281; F05D 2250/75; F04D 29/322; F05B 2260/301
See application file for complete search history.

(56) References Cited

U.S. PATENT DOCUMENTS

| | | | | |
|---|---|---|---|---|
| 7,435,055 | B2 * | 10/2008 | Hansen | F01D 5/3038 416/215 |
| 8,157,531 | B2 * | 4/2012 | Krutzfeldt | F01D 5/3038 416/215 |
| 2005/0129522 | A1 * | 6/2005 | Kite | F01D 5/32 416/220 R |
| 2006/0222502 | A1 * | 10/2006 | Hansen | F01D 5/3038 416/220 R |
| 2009/0016889 | A1 * | 1/2009 | Krutzfeldt | F01D 5/3038 416/204 R |
| 2009/0220345 | A1 * | 9/2009 | Krutzfeldt | F01D 5/3038 416/220 R |
| 2011/0110782 | A1 | 5/2011 | Brittingham | |
| 2015/0101349 | A1 * | 4/2015 | Hansen | F01D 5/303 60/805 |

OTHER PUBLICATIONS

International Search Report dated Mar. 30, 2016, for PCT/EP2016/050990.

* cited by examiner

CLOSING ASSEMBLY FOR CLOSING A BLADE RING, ASSOCIATED BLADE SUPPORTS, TURBOMACHINE, AND METHOD FOR INSERTING A CLOSING ASSEMBLY

CROSS REFERENCE TO RELATED APPLICATIONS

This application is the US National Stage of International Application No. PCT/EP2016/050990 filed Jan. 19, 2016, and claims the benefit thereof. The International Application claims the benefit of European Application No. EP15153995 filed Feb. 5, 2015. All of the applications are incorporated by reference herein in their entirety.

FIELD OF INVENTION

The invention relates to a closing assembly for closing a blade ring which is inserted into an encircling T-groove of a blade support of a turbomachine, having two insert elements which each have a C-shaped basic shape having a resting leg, a retention leg, and a connection leg that connects the resting leg to the retention leg and which each are configured for encompassing one web of the T-groove, wherein the resting leg engages above the web and the retention leg engages below the web, and having an intermediate element that is positionable between the insert elements and is configured to prevent the latter from moving toward the center of the T-groove.

BACKGROUND OF INVENTION

Closing assemblies of this type for a blade ring of a turbomachine are known in various design embodiments in the prior art and serve for closing a blade ring which is attached to a blade support, in particular a rotor disk, of a turbomachine.

Turbomachines are used as working machines or power generation machines. As working machines, said turbomachines serve for setting fluids in motion by generating a flow. As power generation machines, said turbomachines are employed when the kinetic energy of a fluid flow is to be converted to another form of energy, for example electrical energy. Depending on the type of fluid, on the flow direction of the energy, and on the construction of the turbomachines, a differentiation is made between propellers, ventilators, compressors, and jet engines, the former being working machines, and between wind power plants, water turbines, steam turbines, and gas turbines, which are to be considered power generation machines.

Such turbomachines always comprise at least one rotor disk which is held in a rotationally fixed manner on a shaft and conjointly with said shaft forms a rotor. A plurality of blades is usually disposed and held on an external circumferential face of the rotor disk in such a manner that the blades protrude outward in the radial direction. The blades have platforms with engagement elements disposed thereon, said engagement elements being inserted into a T-groove that encircles the circumferential face and being fixed in the radial direction in said T-groove.

It is usual for a blade ring that encircles the rotor disk to be formed in such a manner that two adjacent blades are always mutually spaced apart by an intermediate piece. However, for reasons of space, a normal integral intermediate piece can no longer be inserted into the intermediate space between the first inserted blade and the last inserted blade. Instead, this gap is filled by a closing assembly which in the circumferential direction has the same extent as an intermediate piece but is not configured in an integral manner but comprises a plurality of components that are releasably interconnectable.

A closing assembly of the type mentioned at the outset is known from U.S. Pat. No. 7,435,055 B2. Said closing assembly comprises two insert elements which have a C-shaped basic shape and are configured in such a manner that said insert elements can encompass the webs of the encircling T-groove. The closing assembly furthermore comprises an intermediate element which can be positioned between the two insert elements so as to prevent the latter from moving toward the center of the T-groove. The intermediate element is retained between the insert elements by a locking ring. To this end, the locking ring is connected to a positioning means which penetrates a through bore of the intermediate element and adjacent to the groove base engages in respective recesses of the insert elements.

In order for this closing assembly to be assembled, the two insert elements are first inserted into the T-groove in such a manner that said insert elements in each case encompass one web of the T-groove. The positioning means is then introduced into the T-groove between the two insert elements until said positioning means comes to bear on the groove base. The positioning means is brought to engage with the recesses of the insert elements by rotation. In a next step, the intermediate element is inserted completely into the intermediate space between the insert elements, wherein the positioning means is received in the bore of the intermediate element. On account of the inserted intermediate element, the positioning means is prevented from rotating about the longitudinal axis thereof such that said positioning means is captively engaged in the recesses of the insert elements. Finally, the locking ring is plug-fitted onto the free end of the positioning means. On account thereof, the intermediate element is fixedly held in the position thereof between the insert elements.

When the locking ring is released in the operation of the turbomachine, the intermediate element on account of the acting centrifugal force is ejected from the T-groove such that said intermediate element can no longer prevent the positioning means from rotating about the longitudinal axis thereof. When the positioning means thereafter by virtue of vibrations and on account of rotation loses the engagement thereof in the recesses of the insert elements, said positioning means is likewise ejected from the T-groove such that the two insert elements are no longer fixedly held in the positions thereof and in turn can leave the T-groove. The turbomachine can be damaged by the ejected elements of the closing assembly per se and as a result of the loss of the closure of the blade ring, this having the consequence of corresponding downtime.

SUMMARY OF INVENTION

Proceeding from this prior art, it is an object of the present invention to provide a closing assembly of the type mentioned at the outset which is of simple construction and has good manageability and a secure seat.

In order for the object according to the invention to be achieved, the present invention provides a closing assembly of the type mentioned at the outset, the intermediate element of said closing assembly in the fitted state being configured to engage below the retention legs of the insert elements, wherein the intermediate element is assigned positioning means which are configured to be supported between the groove base of the T-groove and the intermediate element and to position the intermediate element at a desired spacing from the groove base.

The closing assembly according to the invention thus comprises two insert elements having a C-shaped basic shape which in each case encompass one web of the T-groove, and an intermediate element that is positioned between the insert elements and fixes the two insert elements in the intended positions thereof. The spacing of the intermediate element from the groove base can be adjusted as desired by way of positioning means which are supported between the groove base of the T-groove and the intermediate element. In particular, it is not necessary for the functioning of the closing assembly that the positioning means urge the intermediate element toward the insert elements while maximizing the spacing from the groove base. Rather, the elements of the closing assembly can be fitted in the T-groove so as to have some degree of clearance, this reducing the stress on the elements on account of the influence of force and increasing the service life of the closing assembly. Even if the positioning means is released in the operation of the turbomachine, the centrifugal force holds the intermediate element that engages below the insert elements in the intended position such that the insert elements also remain fixed and cannot move toward the center of the T-groove. The closing assembly according to the invention furthermore has the advantage that each element in the assembly can be fitted individually and sequentially, on account of which good manageability is guaranteed. Moreover, the closing assembly comprises elements of simple construction which do not have to be manufactured in a complex manner by turning or milling.

In one design embodiment of the closing assembly according to the invention, in each case one protrusion which projects from the connection leg in a direction that is counter to the resting leg of the insert element is provided on the insert elements, said protrusion being disposed in particular in the upper region of the connection leg, advantageously so as to be level in height with the resting leg. On account of such a protrusion the insert element can be supported in the upper region thereof on the intermediate element so as not to move toward the center of the T-groove.

An upper side of the protrusion herein can align with an upper side of the resting leg. On account thereof, a smooth upper side of the insert element is achieved such that a favorable flow profile of the hot gas along the closing assembly can result.

In one design embodiment according to the invention, the intermediate element has a substantially T-shaped basic shape, having a longitudinal web that extends in a longitudinal direction, and a transverse web that extends transversely to the longitudinal web and is configured to engage below the retention legs of the insert elements, wherein the longitudinal web protrudes from the transverse web in particular in a centric manner. The transverse web prevents the intermediate element from being able to move out of the T-groove. After all, the retention legs of the inserted insert elements restrict the mobility of the transverse web of the intermediate element to the region between a lower side of the retention legs of the insert elements and the groove base.

In a refinement of this design embodiment, the longitudinal web at the free end thereof in the transverse direction of the T-groove has a width of such a manner that said longitudinal web is positionable between the protrusions of the insert elements that are inserted into the T-groove so as to bear on said protrusions or to have a clearance therefrom, in order to prevent the insert elements in the upper regions thereof from moving toward the center of the T-groove. The free end of the longitudinal web in terms of the width thereof is configured to fill the intermediate space that remains between the protrusions of the inserted insert elements.

In one variant of the closing assembly according to the invention, the width of the longitudinal web of the intermediate element decreases in a conical manner in the direction of the free end of said longitudinal web. This, in a manner largely independent of production tolerances, enables a precise fixation of the insert elements when the positioning means is supported between the intermediate element and the groove base.

The longitudinal web of the intermediate element can have a height of such a manner that the free end of said longitudinal web terminates so as to be flush with the protrusions of the two insert elements in the fitted state. A longitudinal web of this height ensures that no steps that are detrimental to the flow are created between the protrusions of the insert elements and that free end of the longitudinal web of the intermediate element that is disposed between the protrusions.

The sum of the heights of one protrusion and of the intermediate element is advantageously smaller than the depth of the T-groove, such that the free end of the longitudinal web is engaged above by a protrusion of an inserted insert element when the intermediate element in the T-groove is displaced in the transverse direction in such a manner that the longitudinal web comes to bear on the connection leg of the insert element. On account thereof, the intermediate element can at least partially be displaced under the protrusion of the already inserted insert element when the latter stands on the groove base, so as to make sufficient space for inserting the second insert element.

In one further design embodiment, the width of the transverse web of the intermediate element in the transverse direction is larger than the clear spacing between the two mutually opposite webs of the T-groove in which the closing assembly is to be installed. A transverse web of this width prevents the intermediate element from leaving the T-groove even when no insert element has been inserted into the T-groove.

The length of the intermediate element in the longitudinal direction of the T-groove advantageously corresponds to the length of the insert elements. The intermediate element in this instance cannot rotate about a longitudinal axis in such a manner that the transverse web loses the engagement below the retention legs of the insert elements or the webs of the T-groove.

In one further design embodiment of the closing assembly according to the invention, steps are configured on both sides of the longitudinal web in a transitional region between the longitudinal web and the transverse web of the intermediate element, said steps in each case being assigned to the insert elements so as to prevent the insert elements in the lower regions thereof from moving toward the center of the T-groove, wherein the steps are configured in such a manner that said steps are positionable between the connection legs of the insert elements that are inserted into the T-groove, so as to bear on said connection legs or to have a clearance therefrom. The steps in terms of the lower region of the insert elements fulfill the same function as the protrusions of the insert elements in the upper region of the latter.

In the case of one design embodiment of the closing assembly according to the invention, free spaces can remain between the protrusions of the insert elements and the steps of the intermediate element, said free spaces in each case extending on both sides of the longitudinal web of the intermediate element toward the connection legs of the insert elements. These free spaces are used during fitting of the closing assembly to provide adequate space for inserting the second insert element when the first insert element and the intermediate element have already been inserted into the T-groove.

A threaded bolt which is screw-fittable in such a manner into a threaded bore that penetrates the intermediate element in the longitudinal direction thereof that said threaded bolt projects in the direction of the groove base and is capable of being brought to bear on the latter so as to set the radial spacing of the intermediate element from the groove base can be provided as a positioning means. The threaded bolt can thus serve for lifting the intermediate element off the groove base in the direction of the inserted insert elements.

The threaded bolt advantageously has a length which corresponds to the depth of the T-groove. A threaded bolt of this length in the fitted state neither projects from the T-groove nor can be sunk into the T-groove. Rather, the end face of said threaded bolt terminates so as to be flush with the end face of the longitudinal web, this in the interaction with the aligned upper sides of the insert elements ensuring flow-facilitating conditions.

The present invention furthermore provides a blade support having an encircling T-groove in which a plurality of blades and intermediate pieces are disposed in an alternating manner, wherein a closing assembly according to the invention is inserted into an intermediate space between two blades. Accordingly, the present invention provides a turbomachine in which at least one blade support according to the invention is installed.

The present invention furthermore provides a blade support having a closing assembly according to the invention, a turbomachine having such a blade support.

The object stated above is finally achieved by a method for inserting a closing assembly according to the invention into an encircling T-groove of a blade support, said method comprising the following steps:—the intermediate element is inserted into the T-groove in such a manner that the former bears on a groove base of the T-groove;—the intermediate element in the T-groove is displaced in the transverse direction of the latter such that the former comes to bear on a web of the T-groove;—an insert element is inserted into the T-groove in such a manner that the former encompasses a web of the T-groove;—the intermediate element in the T-groove is displaced in the transverse direction of the latter such that the intermediate element comes to bear on the connection leg of the insert element that is inserted into the T-groove;—the further insert element is inserted into the T-groove in such a manner that the former encompasses the other web of the T-groove;—the intermediate element is displaced to the center of the T-groove;—the intermediate element by way of the positioning means is positioned so as to be spaced apart from the groove base in such a manner that the intermediate element engages below the retention legs of the insert elements and prevents the two insert elements from moving toward the center of the T-groove.

BRIEF DESCRIPTION OF THE DRAWINGS

Further features and advantages of the present invention will become evident by means of the following description of an embodiment of the closing assembly according to the invention with reference to the appended drawing in which.

DETAILED DESCRIPTION OF INVENTION

Figure 1:
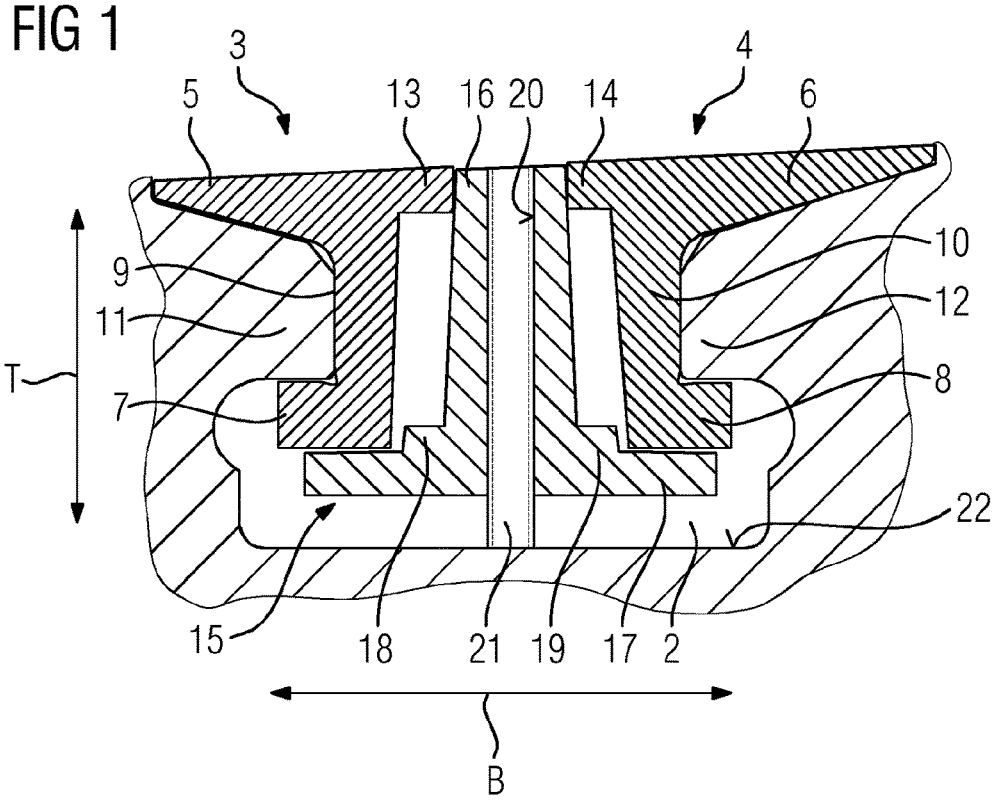
FIG. 1 shows a schematic cross-sectional view of a closing assembly according to one embodiment of the present invention.
Figure 2:
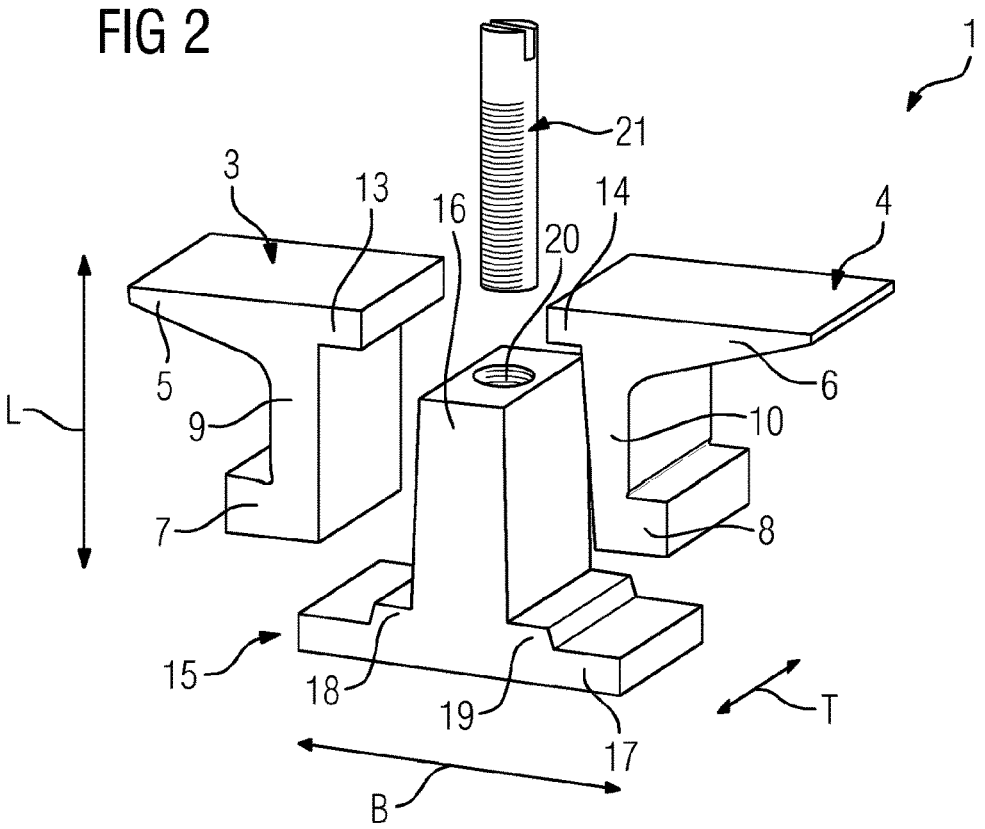
FIG. 2 shows a perspective exploded view of the closing assembly illustrated in FIG. 1.

FIGS. 1 and 2 show an embodiment of the closing assembly 1 according to the invention. Said closing assembly 1 is inserted into an encircling T-groove 2 of a blade support of a turbomachine, so as to fill the last remaining intermediate space between two blades of a blade ring to be formed and, on account thereof, to close the blade ring. The blade support can be a rotor disk of a gas or steam turbine, for example.

The closing assembly 1 comprises two insert elements 3, 4 which each have a C-shaped basic shape and comprise a resting leg 5, 6, a retention leg 7, 8, and a connection leg 9, 10 that connects the resting leg 5, 6 to the retention leg 7, 8. The insert elements 3, 4 each are configured for encompassing one web 11, 12 of the T-groove 2. The resting legs 5, 6 herein respectively engage above the webs 11, 12 of the T-groove 2, while the retention legs 7, 8 engage below the webs 11, 12 of the T-groove 2.

Furthermore, one protrusion 13, 14 which is disposed so as to be level in height with the resting leg 5, 6 and projects from the connection leg 9, 10 in the direction counter to the respective resting leg 5, 6, that is to say toward the center of the T-groove, is provided on each insert element 3, 4. The upper side of the protrusion 13, 14 herein is aligned with the upper side of the resting leg 5, 6. On account thereof, an overall smooth flow-facilitating upper side of the insert elements 3, 4 results.

The closing assembly 1 furthermore comprises an intermediate element 15 which is positioned in the T-groove 2 between the insert elements 3, 4. The intermediate element 15 is configured to prevent the two insert elements 3, 4 from moving into the center of the T-groove 2. The intermediate element 15 has a substantially T-shaped basic shape, having a longitudinal web 16, a transverse web 17 which extends in the transverse direction of the T-groove 2 being disposed on the lower end of said longitudinal web 16.

The transverse web 17 is configured to engage below the retention legs 7, 8 of the insert elements 5, 6. Specifically, the width of the transverse web 17 of the intermediate element 15 is larger than the clear spacing between the two mutually opposite webs 11, 12 of the T-groove 2. Consequently, the intermediate element 15 cannot leave the T-groove 2 without being pivoted about an axis that runs in the circumferential direction of the T-groove 2. The length of the intermediate element 15 in the circumferential direction of the T-groove 2 corresponds to the clear spacing between two adjacent blades which are inserted into the T-groove 2. Consequently, the intermediate element 15 in the installed state cannot rotate about an axis that runs in the circumferential direction.

The longitudinal web 16 protrudes from the transverse web 17 in a centric manner and has a length of such a manner that the free end of said longitudinal web 16 in the fitted state terminates so as to be flush with the protrusions 13, 14 of the insert elements 3, 4. This provides a smooth flow-facilitating upper side of the fitted closing assembly 1.

The width of the longitudinal web 16 of the intermediate element 15 decreases in a conical manner from the transverse web 17 in the direction of the free end of said longitudinal web 16, and at said free end has a width of such a manner that said longitudinal web 16 is positionable between the protrusions 13, 14 of the insert elements 5, 6 that are inserted into the T-groove 2 so as to bear on said protrusions 13, 14 or to have a clearance therefrom. Said longitudinal web 16 in this position prevents the upper regions of the insert elements 5, 6 from moving toward the center of the T-groove 2.

Steps 18, 19 which are in each case assigned to the insert elements 3, 4 are configured on both sides of the longitudinal web 16 between the longitudinal web 16 and the transverse web 17 of the intermediate element 15. Said steps 18, 19 prevent the lower regions of the insert elements 3, 4 from moving into the center of the T-groove 2. To this end, the entire width of the steps 18, 19 is chosen in such a manner that the steps 18, 19 are positioned between the connection legs 9, 10 of the inserted insert elements 5, 6 so as to bear on said connection legs 9, 10 or to have a clearance therefrom.

The summed length of a protrusion 13, 14 and of the intermediate element 15 herein is smaller than the depth of the T-groove 2 such that the free end of the longitudinal web 16 can in each case be engaged above by the protrusions 13, 14 of the inserted insert elements 5, 6 when the intermediate element 15 in the T-groove 2 is displaced in the transverse direction of the latter in such a manner that the longitudinal web 16 comes to bear on the connection legs 9, 10 of the insert elements 5, 6.

In the fitted state of the closing assembly 1, free spaces remain between the connection legs 9, 10 of the insert elements 3, 4 and the longitudinal web 16 of the intermediate element 15, the size of said free spaces being determined substantially by the protrusions 13, 14 and the steps 18, 19. The free spaces that are created on both sides of the longitudinal web 16 between the protrusions 13, 14 and the steps 18, 19 are utilized during the insertion procedure to provide adequate space for inserting the subsequent insert element 3, 4 between the longitudinal web 16 and the web 11, 12 by displacing the intermediate element 15 temporarily under the insert element 3, 4 inserted first.

A threaded bore 20 which penetrates the intermediate element 15 in the longitudinal direction of the latter is provided in the longitudinal web 16 of the intermediate element 15. A threaded bolt 21 is screw-fitted into this threaded bore 20. The threaded bolt 21 has a length which corresponds to the depth of the T-groove 2.

In this way, the threaded bolt 21 does not protrude from the T-groove 2 when said threaded bolt 21 is supported on the groove base 22 of the T-groove 2, and moreover in the fitted state of the closing assembly terminates so as to be flush with the longitudinal web 16 of the intermediate element 15.

FIGS. 3 to 9 show the closing assembly 1 in individual stages of the insertion method.

Figure 3:
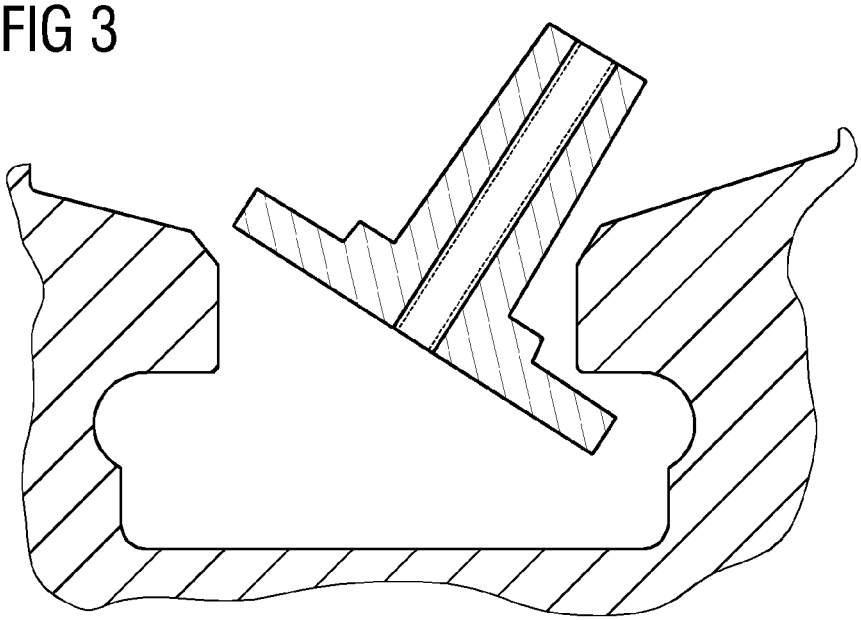
FIG. 3 shows a schematic cross-sectional view of the closing assembly illustrated in FIG. 2, when the intermediate element is being inserted.

First, the intermediate element 15 is inserted into the intermediate space that remains between two blades. To this end, pivoting the intermediate element 15 about an axis that is disposed in the circumferential direction of the T-groove 2 is required since the width of the transverse web 17 is larger than the clear spacing between the mutually opposite webs 11, 12 of the T-groove 2 (FIG. 3).

Figure 4:
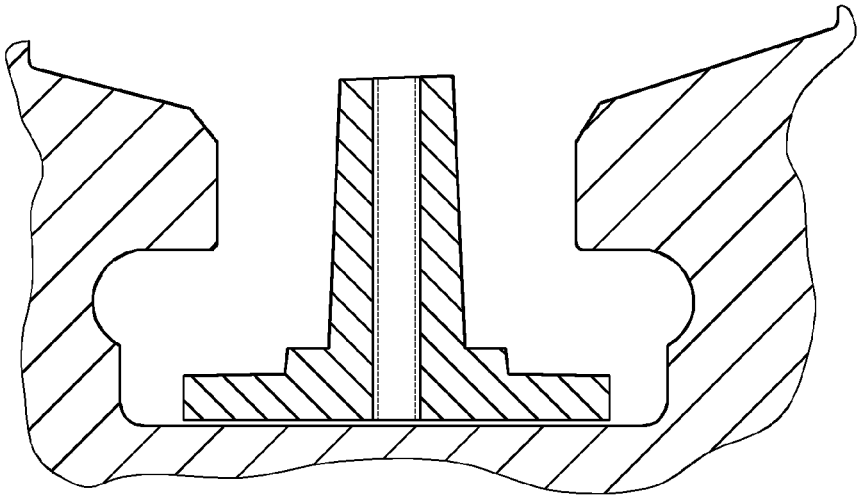
FIG. 4 shows a schematic cross-sectional view of the closing assembly illustrated in FIG. 2, once the intermediate element has been inserted.

Once the transverse web 17 of the intermediate element 15 has passed the constriction between the two webs 11, 12, the intermediate element 15 is pivoted in such a manner that the transverse web 17 of the latter comes to bear on the groove base 22 (FIG. 4).

Figure 5:
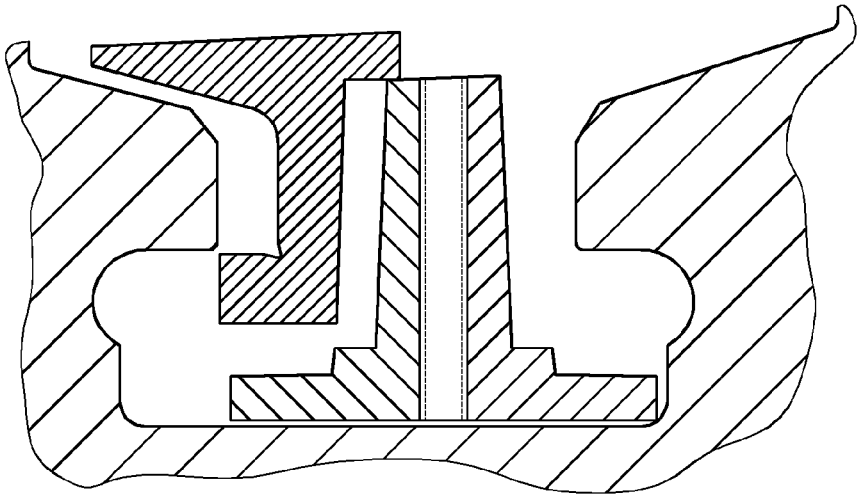
FIG. 5 shows a schematic cross-sectional view of the closing assembly illustrated in FIG. 2, while the first insert element is being inserted.

The intermediate element 15 in the T-groove is now displaced in the transverse direction, so as to provide adequate space for inserting an insert element 3, 4 between a web 11, 12 and the longitudinal web 16 of the intermediate element 15 (FIG. 5).

Figure 6:
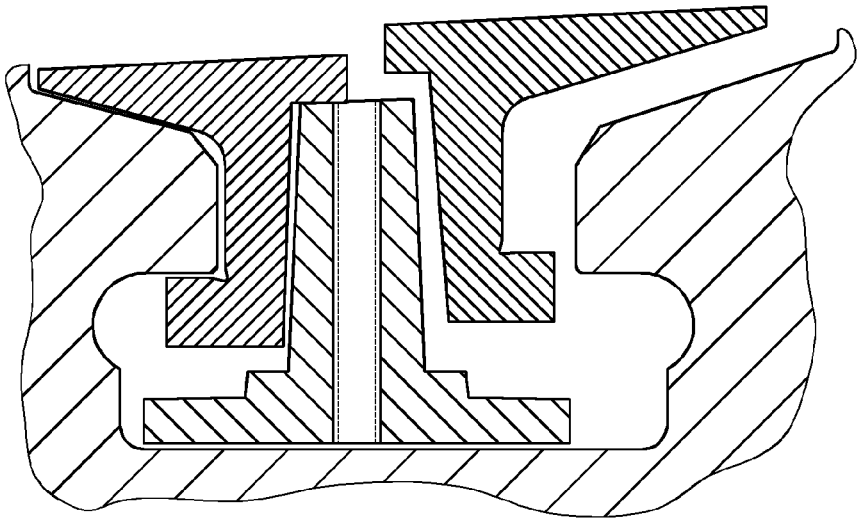
FIG. 6 shows a schematic cross-sectional view of the closing assembly illustrated in FIG. 2, while the second insert element is being inserted.

The first insert element 3, 4 thereafter is positioned in the T-groove 2 in such a manner that the former encompasses the first web 11, 12. The intermediate element 15 in the T-groove 2 is displaced in the transverse direction until the longitudinal web 15 of said intermediate element 15 comes to bear on the connection leg 9, 10 of the positioned insert element 3, 4. This is possible because the added lengths of the protrusion 13, 14 and of the intermediate element 15 are chosen such that the free end of the longitudinal web 15 fits under the protrusion 13, 14, and that the step 18, 19 also finds space under the retention leg 7, 8 of the insert element 3, 4. In this position of the intermediate element 15 adequate space is created for the further insert element 3, 4 to be inserted into the T-groove 2 (FIG. 6).

Figure 7:
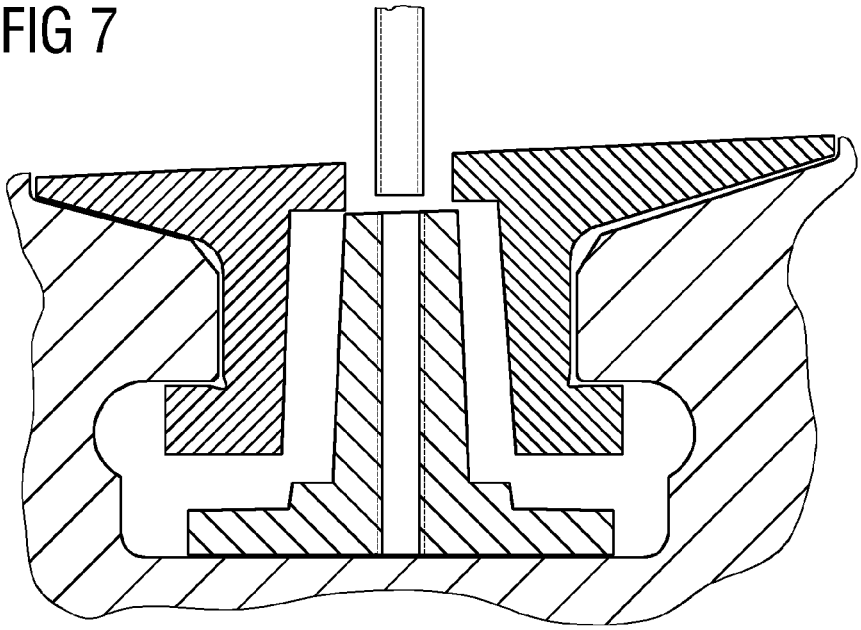
FIG. 7 shows a schematic cross-sectional view of the closing assembly illustrated in FIG. 2, prior to the positioning means being inserted.

When the further insert element 3, 4 has been positioned so as to encompass the further web 11, 12, the intermediate element 15 is displaced into the center of the T-groove 2 (FIG. 7).

Figure 8:
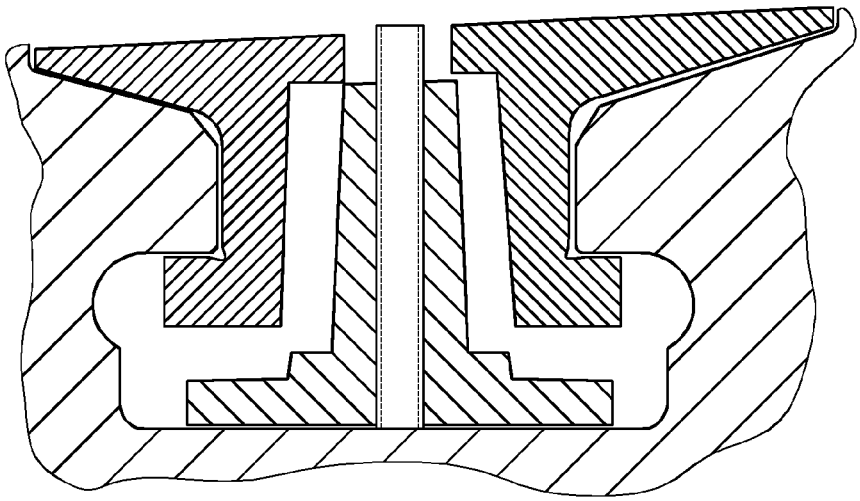
FIG. 8 shows a cross-sectional view of the closing assembly illustrated in FIG. 2, having the positioning means inserted.

The threaded bolt 21 is now screw-fitted into the threaded bore 20 of the intermediate element 20 until the threaded bolt 21 is supported on the groove base 22 (FIG. 8).

Figure 9:
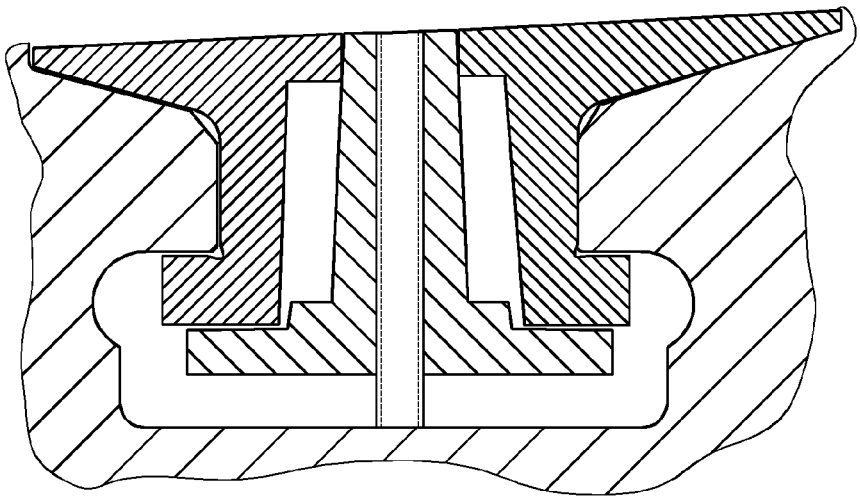
FIG. 9 shows a schematic cross-sectional view of the closing assembly illustrated in FIG. 2, having the intermediate element positioned.

Further screwing-in of the threaded bolt 21 leads to the intermediate element 15 being lifted from the groove base 22 while forming a spacing. The threaded bolt 21 is finally screw-fitted so far that the longitudinal web 16 terminates so as to be flush with the insert elements 3, 4, on account of which the steps 18, 19 are disposed between the lower regions of the connection legs 9, 10 of the insert elements 3, 4, and the free end of the longitudinal web 16 is positioned between the protrusions 13, 14 (FIG. 9).

In this fitted state of the closing assembly, the two insert elements 3, 4 in the upper and the lower region thereof are now prevented from moving into the center of the T-groove 2. Simultaneously, the intermediate element 15 is prevented by the protrusions 13, 14 and the steps 18, 19 from moving in the transverse direction of the T-groove 2. To this end, it is not necessary for the intermediate element 15 to be pressed with a great force below the retention legs 7, 8 of the insert elements 3, 4, while stressing the threaded bolt 21 and the threaded bore 20. This reduces the risk of overstressing the positioning means 21 and of the latter being damaged by virtue of material fatigue.

While the invention has been illustrated and described in detail by way of the preferred exemplary embodiment, the invention is not limited by the examples disclosed, and other variants can be derived therefrom by a person skilled in the art without departing from the scope of protection of the invention.

The invention claimed is:

1. A closing assembly for closing a blade ring which is inserted into an encircling T-groove of a blade support of a turbomachine, comprising:

two insert elements which each comprises a C-shape comprising a resting leg, a retention leg, and a connection leg that connects the resting leg to the retention leg and which each are configured for encompassing one web of two webs of the T-groove, wherein in each case the resting leg engages above the web and the retention leg engages below the web, wherein each insert element comprises a bottom surface that is closest to a groove base of the T-groove, and wherein each bottom surface is set apart from the groove base by a gap, an intermediate element comprising a transverse web and a longitudinal web extending from the transverse web, wherein in a fitted state the transverse web is configured to extend laterally into each gap and beneath each bottom surface and the longitudinal web is configured to fit between the resting legs, thereby maintaining a lateral separation of the two insert elements, and a positioning means configured to push against the groove base to adjustably lift the intermediate element away from the groove base and into the fitted state between the two insert elements.

2. The closing assembly as claimed in claim 1, wherein each insert element of the two insert elements comprises a protrusion which projects from the connection leg in a direction that is counter to the resting leg and toward the longitudinal web, and wherein the longitudinal web fits between each protrusion in the fitted state.

3. The closing assembly as claimed in claim 2, wherein an upper side of each protrusion aligns with an upper side of each resting leg in the fitted state.

4. The closing assembly as claimed in claim 2, wherein the longitudinal web of the intermediate element comprises a height of such a manner that a free end of said longitudinal web terminates so as to be flush with the protrusions of the two insert elements in the fitted state.

5. The closing assembly as claimed in claim 2, wherein each protrusion is disposed in an upper region of the connection leg so as to be level in height with the resting leg.

6. The closing assembly as claimed in claim 1, wherein the intermediate element comprises a T-shape comprising the longitudinal web that extends in a longitudinal direction and the transverse web that extends transversely to the longitudinal web, wherein the longitudinal web protrudes from a center of the transverse web.

7. The closing assembly as claimed in claim 6, wherein a free end of the longitudinal web comprises a width of such a manner that in the fitted state said longitudinal web is disposed between protrusions of the two insert elements that are inserted into the T-groove so as to bear on said protrusions or to comprise a clearance therefrom, in order to prevent upper regions of the two insert elements from moving toward a center of the T-groove.

8. The closing assembly as claimed in claim 7, wherein the width of the longitudinal web of the intermediate element decreases in a conical manner in a direction of the free end of said longitudinal web.

9. The closing assembly as claimed in claim 6, wherein a sum of a height of one protrusion and a height of the intermediate element is smaller than a depth of the T-groove, such that when the intermediate element is lowered onto the groove base of the T-groove and is displaced in a transverse direction of the T-groove the longitudinal web fits under the one protrusion and comes to bear on a connection leg of a first insert element of the two insert elements.

10. The closing assembly as claimed in claim 6, wherein a width of the transverse web of the intermediate element in the transverse direction of the T-groove is larger than a clear spacing between the two webs of the T-groove in which the closing assembly is to be installed.

11. The closing assembly as claimed in claim 6, wherein a height of the longitudinal web equals a height of each insert element of the two insert elements in the fitted state.

12. The closing assembly as claimed in claim 6, wherein the intermediate element comprises steps configured on both sides of the longitudinal web in a transitional region between the longitudinal web and the transverse web, wherein in the fitted state the steps are disposed between the connection legs of the two insert elements so as to bear on said connection legs or to have a clearance therefrom to thereby prevent lower regions of the two insert elements from moving toward the center of the T-groove.

13. The closing assembly as claimed in claim 12, wherein in the fitted state free space remains between the protrusions of the two insert elements and the steps of the intermediate element.

14. The closing assembly as claimed in claim 1, wherein the positioning means comprises a threaded bolt which is screw-fittable into a threaded bore that penetrates the intermediate element in a longitudinal direction thereof so that said threaded bolt projects toward the groove base and is capable of being brought to bear on the groove base so as to lift the intermediate element from the groove base into the fitted state.

15. The closing assembly as claimed in claim 14, wherein the threaded bolt comprises a length equal to a depth of the T-groove.

16. A blade support comprising:

the encircling T-groove in which a plurality of blades and a plurality of intermediate pieces are disposed in an alternating manner, and the closing assembly as claimed in claim 1 inserted into an intermediate space between two blades of the plurality of blades.

17. A turbomachine comprising:

at least one blade support as claimed in claim 16.

18. A method for inserting the closing assembly as claimed in claim 1 into the encircling T-groove of the blade support, said method comprising:

inserting the intermediate element into the T-groove in such a manner that the intermediate element bears on the groove base of the T-groove;

displacing the intermediate element in the T-groove in a transverse direction of the T-groove;

inserting a first insert element of the two insert elements into the T-groove in such a manner that the first insert element encompasses a first web of the two webs of the T-groove;

displacing the intermediate element in the T-groove in the transverse direction of the T-groove such that the intermediate element comes to bear on a connection leg of the first insert element that is inserted into the T-groove;

inserting a second insert element of the two insert elements into the T-groove in such a manner that the second insert element encompasses a second web of the two webs of the T-groove;

displacing the intermediate element toward a center of the T-groove;

positioning the intermediate element into the fitted state by way of the positioning means, wherein in the fitted state the intermediate element is spaced apart from the groove base, engages below the retention legs of the two insert elements, and is positioned between the two insert elements and thereby prevents the two insert elements from moving toward the center of the T-groove.

19. The closing assembly as claimed in claim 1, wherein the transverse web supports the two insert elements at a distance above the groove base.

* * * * *